United States Patent [19]

Bottum

[11] 4,103,509

[45] Aug. 1, 1978

[54] WATER HEATER-DEHUMIDIFIER COMBINATION HEAT PUMP

[76] Inventor: Edward W. Bottum, 9357 Spencer Rd., Brighton, Mich. 48116

[21] Appl. No.: 772,538

[22] Filed: Feb. 28, 1977

[51] Int. Cl.[2] ..... F25B 27/02; F25B 39/02

[52] U.S. Cl. ..... 62/238; 62/518

[58] Field of Search ..... 62/238, 238 W, 259, 62/324, 518; 165/125, 48, 56

[56] References Cited

U.S. PATENT DOCUMENTS

| | | | |
|---|---|---|---|
| 2,125,842 | 8/1938 | Eggleston | 62/238 W |
| 2,470,956 | 5/1949 | Savidge | 62/518 |
| 2,516,094 | 7/1950 | Ruff | 62/238 W |
| 2,751,761 | 6/1956 | Borgerd | 62/238 W |

FOREIGN PATENT DOCUMENTS

| | | | |
|---|---|---|---|
| 2,556,623 | 7/1976 | Fed. Rep. of Germany | 62/324 |

*Primary Examiner*—Lloyd L. King

*Attorney, Agent, or Firm*—Whittemore, Hulbert & Belknap

[57] ABSTRACT

The water heater-dehumidifier combination heat pump comprises a heat pump system package including an evaporator which serves as a dehumidifier and a condenser which is in heat exchange relationship with water in a hot water tank for heating of same.

6 Claims, 2 Drawing Figures

WATER HEATER-DEHUMIDIFIER COMBINATION HEAT PUMP

BACKGROUND OF THE INVENTION

Figure 1:
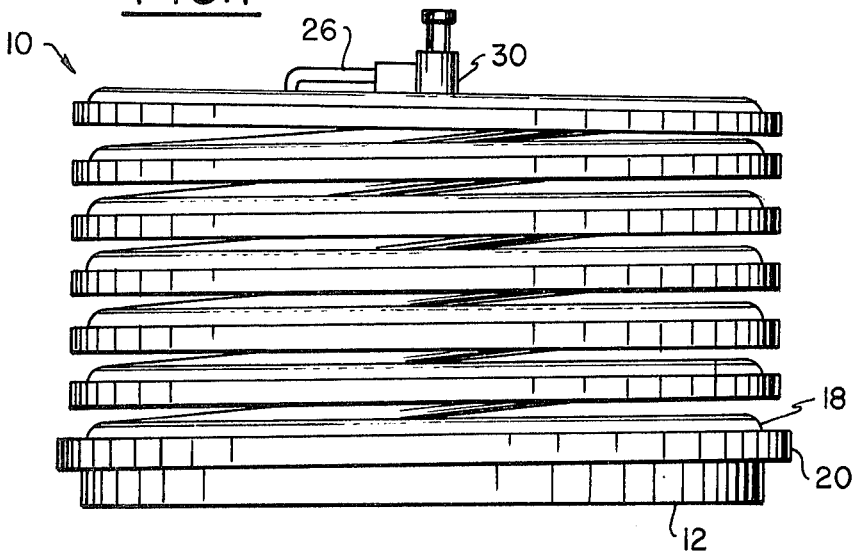

National attention has recently turned toward the conservation and efficient utilization of energy. This has come about as a consequence of the recognition of the finite amount of non-renewable fossil energy sources which has formed the energy basis for modern industrial societies.

The present invention concerns itself with both the conservation and efficient utilization of energy. A heat pump system is used in conjunction with a hot water tank of the type normally found in residences. Using a heat pump to directly heat the water in a water tank will increase the coefficient of performance by a factor of two or three as compared with the cost of operating an electric resistance water heater.

In accordance with the present invention, the heat pump is also utilized as a dehumidifier with no additional energy expenditure. It is obvious that the overall coefficient of performance of such a system will be very high. Water heaters are often located in a basement or other damp area and the benefits of a dehumidifier are especially desirable in such areas.

The entire package may be located close to the water heater. An electric fan may be used to circulate water over the evaporator of the heat pump, the evaporator serving as a dehumidifier coil. However, in the preferred design, an electric fan is eliminated. Instead, a tube (with or without extended surface) is wrapped around the area of the compressor and condenser and air is allowed to circulate by convection over this tube, which tube forms the evaporator of the heat pump system.

The unit is compact and occupies little more space than a standard dehumidifier but will provide an adequate supply of hot water for the average family. The water may be heated and year around dehumidification provided at a fraction of the cost of operating a standard electric water heater and separate dehumidifier.

SUMMARY OF THE INVENTION

A water heater-dehumidifier combination heat pump is provided. The heat pump system includes a compressor, condenser and evaporator operatively connected together. The evaporator includes means for the circulation of air thereover in heat exchange relationship therewith for the purpose of dehumidifying the air. A hot water tank including a water inlet and a water outlet is provided. A heat exchange structure including means for the flow of water therethrough is placed in heat exchange relationship with the condenser. The heat exchange structure includes a water inlet, a water outlet and means for the flow of water therethrough. The water inlet of the heat exchange structure is connected to the water outlet of the hot water tank and the water outlet of the heat exchange structure is connected to the water inlet of the hot water tank for flow of water from the hot water tank through the heat exchange structure and thence back to the hot water tank for the purpose of heating the water.

IN THE DRAWING

Figure 2:
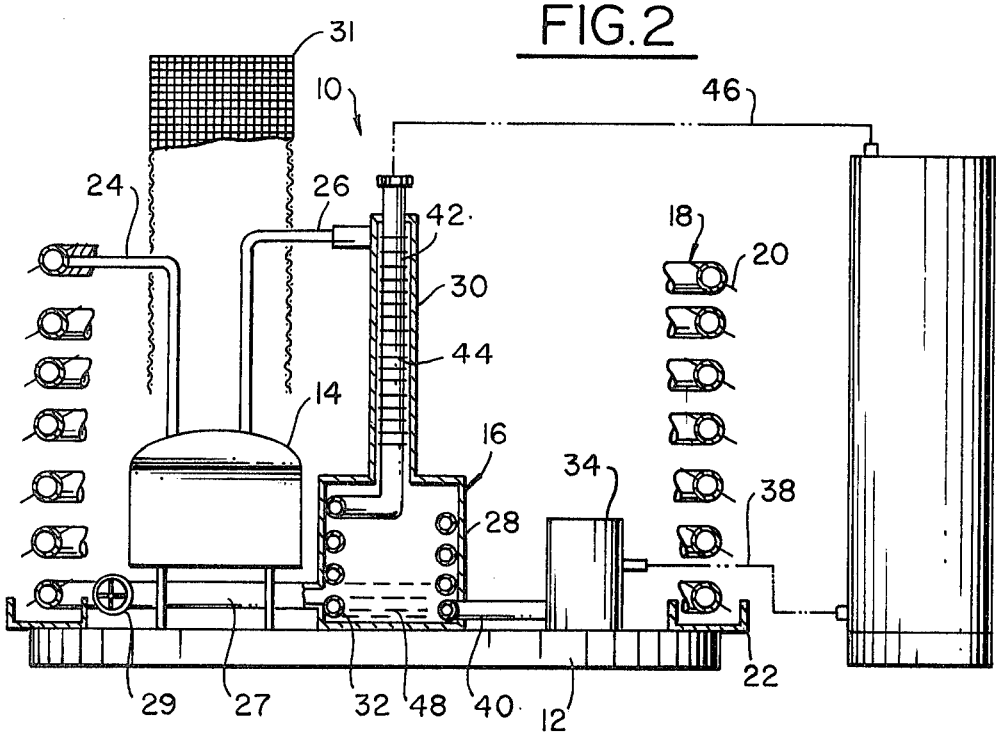

FIG. 1 is an elevational view of one embodiment of the water heater-dehumidifier combination heat pump of the present invention; and FIG. 2 is a sectional view of the combination shown in FIG. 1 illustratively connected to a hot water tank.

Referring to the figures, the water heater-dehumidifier combination heat pump 10 is mounted on a base 12 which may be supported on a floor or other suitable structure. The compressor 14 and condenser 16 of the heat pump system are located centrally of the base 12. A cylindrical mesh flue 31 is provided above compressor 14 to enhance flow over the compressor to help take heat from the compressor. A helical tubular coil is provided around these elements. The helical coil comprises the evaporator 18 of the heat pump system. As will be noted, fins 20 are provided on the evaporator 18 to increase the heat exchange area. The turns of the coil are spaced apart to permit flow of air by convection therearound. An annular condensate trough 22 is provided beneath the evaporator 18 to catch condensate which collects on the evaporator and falls downwardly by gravity.

The outlet of the evaporator 18 is connected to the inlet of the compressor 14 via line 24. The outlet of the compressor 14 is connected to the inlet of the condenser 16 via line 26 and the outlet of condenser 16 is connected to the inlet of evaporator 18 via line 27, thus defining a closed heat pump system. An expansion valve 29 is provided in line 27. Alternately, a capillary tube may be used. Suitable controls and other conventional mechanisms may be provided for the heat pump system as is the common practice.

The condenser 16 has an enlarged lower portion 28 and an elongated relatively narrow upper portion 30. A helical tubular coil 32 is provided in the lower portion 28. A pump 34 is connected to the lower portion of water tank 36 via line 38. The outlet of the pump 34 is connected to the lower end of coil 32 via line 40. A substantially straight tubular portion 42 extends from the upper end of the coil 32 through the upper portion 30 of the condenser. Fins 44 are provided on tubular portion 42 to increase the heat transfer area. The upper end of tubular portion 42 is connected to the upper portion of water tank 36 via line 46.

Operation of the system may now be understood. The compressor 14 receives expanded refrigerant gases from the outlet of the evaporator 18 and compresses these gases. The hot, compressed gases are then injected into the upper portion 30 of the condenser. These hot gases condense into liquid refrigerant as a consequence of heat exchange with the water flowing through the coil 32 and tubular portion 42 which together define a heat exchange structure. The liquid refrigerant 48 settles in the bottom of the lower portion 28 of the condenser. Liquid refrigerant is then flowed to the lower portion of the evaporator 18. This liquid refrigerant flows through and expands in the evaporator, causing a lowering of the temperature of the coils forming the evaporator 18. The connected fins 20 also are reduced in temperature. Water in the air which circulates through the evaporator 18 condenses on the evaporator tubing and fins. This condensed water then flows down the downwardly slanted fins into the trough 22 of the evaporator 18, thereby effectuating the dehumidifying function of the unit.

The water which flows through the coil 32 and tubular portion 42 is heated by the hot refrigerant gases. The portion 42 is in contact with the hottest refrigerant gases which exit from the compressor 14. Therefore, water flowing through the tubular portion 42 is at the highest temperature possible within the system. Thus, water which is relatively hot is desirably flowed into the water tank 36.

Having thus described my invention, I claim:

1. A water heater-dehumidifier heat pump system including a compressor, condenser and evaporator operatively connected together, said evaporator including means for the circulation of air thereover in heat exchange relationship therewith for the purpose of dehumidifying the air, said evaporator being a vertically oriented helical tubular coil with the turns thereof spaced apart to permit flow of air by convection therearound, said coil being of relatively large diameter, said condenser and compressor being physically located within the evaporator coil, a drain structure provided beneath the evaporator to collect water condensate falling by gravity from the evaporator, a hot water tank including a water inlet and a water outlet, a heat exchange structure placed in heat exchange relationship with the condenser, said heat exchange structure including a water inlet, a water outlet and means for the flow of water therethrough, the water inlet of the heat exchange structure being connected to the water outlet of the hot water tank and the water outlet of the heat exchange structure being connected to the water inlet of the hot water tank for flow of water from the hot water tank through the heat exchange structure and thence back to the hot water tank for the purpose of heating the water.

2. The combination as defined in claim 1, further characterized in the provision of heat-conductive fins extending outwardly from the evaporator turns.

3. The combination as defined in claim 1, further characterized in that said heat exchange structure includes a helical coil positioned within the condenser.

4. The combination as defined in claim 3, further characterized in that said condenser includes an elongated tubular inlet portion, said heat exchange structure including a tubular outlet portion extending from said helical coil through said elongated tubular inlet portion of the condenser.

5. The combination as defined in claim 4, further characterized in the provision of a heat-conducting fin structure on the tubular outlet portion of said heat exchange structure.

6. The combination as defined in claim 1, further characterized in the provision of a water pump between the inlet of the heat exchange structure and the water outlet of the hot water tank.

* * * * *